US005893340A

United States Patent [19]

Belin et al.

[11] Patent Number: 5,893,340

[45] Date of Patent: Apr. 13, 1999

[54] EROSION PROTECTION AT LINE DISCONTINUITY FOR ENCLOSURE AND INTERNAL WALLS IN FLUIDIZED BED COMBUSTORS AND REACTORS

[75] Inventors: Felix Belin, Brecksville; David J. Walker, Wadsworth, both of Ohio

[73] Assignee: The Babcock & Wilcox Company, New Orleans, La.

[21] Appl. No.: 08/876,371

[22] Filed: Jun. 16, 1997

[51] Int. Cl.[6] ..... F23G 5/48

[52] U.S. Cl. ..... 122/4 D; 110/245

[58] Field of Search ..... 122/4 D; 110/245

[56] References Cited

U.S. PATENT DOCUMENTS

| | | | |
|---|---|---|---|
| 5,091,156 | 2/1992 | Ijas et al. | 422/146 |
| 5,239,945 | 8/1993 | McCoy | 122/4 D |
| 5,277,151 | 1/1994 | Paulhamus | 122/4 D |
| 5,341,766 | 8/1994 | Hyppanen | 122/4 D |
| 5,361,728 | 11/1994 | Oda et al. | 122/4 D |
| 5,365,889 | 11/1994 | Tang | 122/4 D |

*Primary Examiner*—Philip H. Leung
*Assistant Examiner*—Gregory A. Wilson
*Attorney, Agent, or Firm*—Daniel S. Kalka; Robert J. Edwards

[57] ABSTRACT

A water tube wall or heat transfer surface for use in a circulating fluidized bed combustor or reactor having reduced erosion at a transition between a protective refractory material and the upper wall.

14 Claims, 2 Drawing Sheets

EROSION PROTECTION AT LINE DISCONTINUITY FOR ENCLOSURE AND INTERNAL WALLS IN FLUIDIZED BED COMBUSTORS AND REACTORS

BACKGROUND OF THE INVENTION

1. Field of the Invention

The present invention relates generally to the field of fluidized bed combustor and reactor wall construction and in particular to a new and improved tube wall configuration for protecting and reducing erosion of tube walls in the lower regions of a fluidized bed combustor or reactor.

2. Description of the Related Art

In a circulating fluidized bed reactor, reacting and non-reacting solids are entrained within the enclosure by the upward flow of gases which carry some solids to the reactor exit at the upper end of the reactor. Other, larger quantities of solids are recycled within the reactor enclosure as heavier solids initially carried upwards fall back against the flow of gases. Since the velocity of the upward flow of gases is often much lower adjacent the circulating fluidized bed enclosure walls and heat transfer surfaces within the circulating fluidized bed, most of the solids fall near the walls or heat transfer surfaces.

The amount of solids falling adjacent to the walls and surfaces increases progressively toward the bottom of the circulating fluidized bed. The density of the bed is higher in the lower regions of the furnace, and as a result, the walls and surfaces in the lower regions are subject to increased erosion from contact with the solids.

Further, the reactions occurring in the circulating fluidized bed create chemical reduction conditions against which the walls and heat transfer surfaces must be protected. A protective material (further called refractory) is often used to coat the walls and exposed surfaces in the lower regions of the circulating fluidized bed. The refractory is expensive, since it must withstand high temperatures (between 1400° and 1800° F.), contact erosion from solids, and chemical reduction and by-products from the reaction. The refractory also reduces the efficiency of heat transfer. For this reason refractory is only applied to the walls and exposed surfaces to as low an elevation in the reactor region as possible considering corrosion and erosion conditions. At the point on the walls and surfaces where the coating terminates, a discontinuity is formed where erosion occurs. The erosion is typically in a band about ¼" wide adjacent the top edge of the protective material.

One method of reducing the effect of this erosion is to place a weld overlay from adjacent the discontinuity to several inches above the protective material termination. The weld overlay thus protects the tube wall or heat transfer surface from erosion at the point of discontinuity. Unfortunately, the weld overlay also suffers from erosion and must eventually be replaced, usually at great expense.

Another method of reducing the erosion is shown in U.S. Pat. No. 5,239,945, which discloses a fluidized bed boiler or reactor having water walls which are sloped outwardly from the top, forming a trapezoidal enclosure. Since the furnace walls slope continuously outward, particles falling from the upper regions of the enclosure cannot directly impinge the walls at the line of the tube-refractory interface, and instead fall primarily downward into the bed.

A second wall configuration is disclosed by U.S. Pat. No. 5,091,156, which has a configuration of water walls in a fluidized bed for protecting the refractory lined portion of the walls from erosion by contact with particles in the bed. The initially straight enclosure walls in the upper region are first bent outward adjacent the refractory portion, and then bent a second time inward toward the fluidized bed and opposing wall. The protective refractory coating lines the water wall beginning at the first outward bend such that a smooth transition between the refractory and upper water wall is created.

This wall configuration does not entirely protect the refractory lining from erosion by contact, since the discontinuity is still exposed to downwardly falling particles which may impact the transition at a slight angle. And, neither of the last two wall configurations can be applied to walls or heat transfer surfaces located entirely within the circulating fluidized bed enclosure, such as internal walls.

SUMMARY OF THE INVENTION

It is an object of the present invention to provide an enclosure or interior tube wall of a fluidized bed combustor or reactor having improved erosion resistance properties in the protective refractory material lined regions.

Accordingly, a first embodiment for enclosure tube walls of a fluidized bed combustor or reactor is provided having a vertical straight, upper enclosure wall which is first bent inward towards the furnace center at a slope of less than 10° from the vertical at a point several feet above the upper edge of the refractory lining. After the wall has been brought inward a sufficient horizontal distance, and still above the refractory lining, the enclosure tube wall is bent a second time outward from the furnace center. The wall can then be bent a third time back into the plane of the upper wall, or a plane parallel to the plane of the upper wall, or inward or outward.

A second embodiment of the water wall is for use as an interior wall in a fluidized bed combustor or reactor. A vertical interior water wall is first bent toward one side of the wall at a slope of less than 10° from the vertical. A second bend back toward the second side of the wall is made above the refractory lining. A third bend is made toward the first side of the wall, but the wall is then bent downward in a plane between the plane of the upper wall section and a plane tangential to the second bend.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
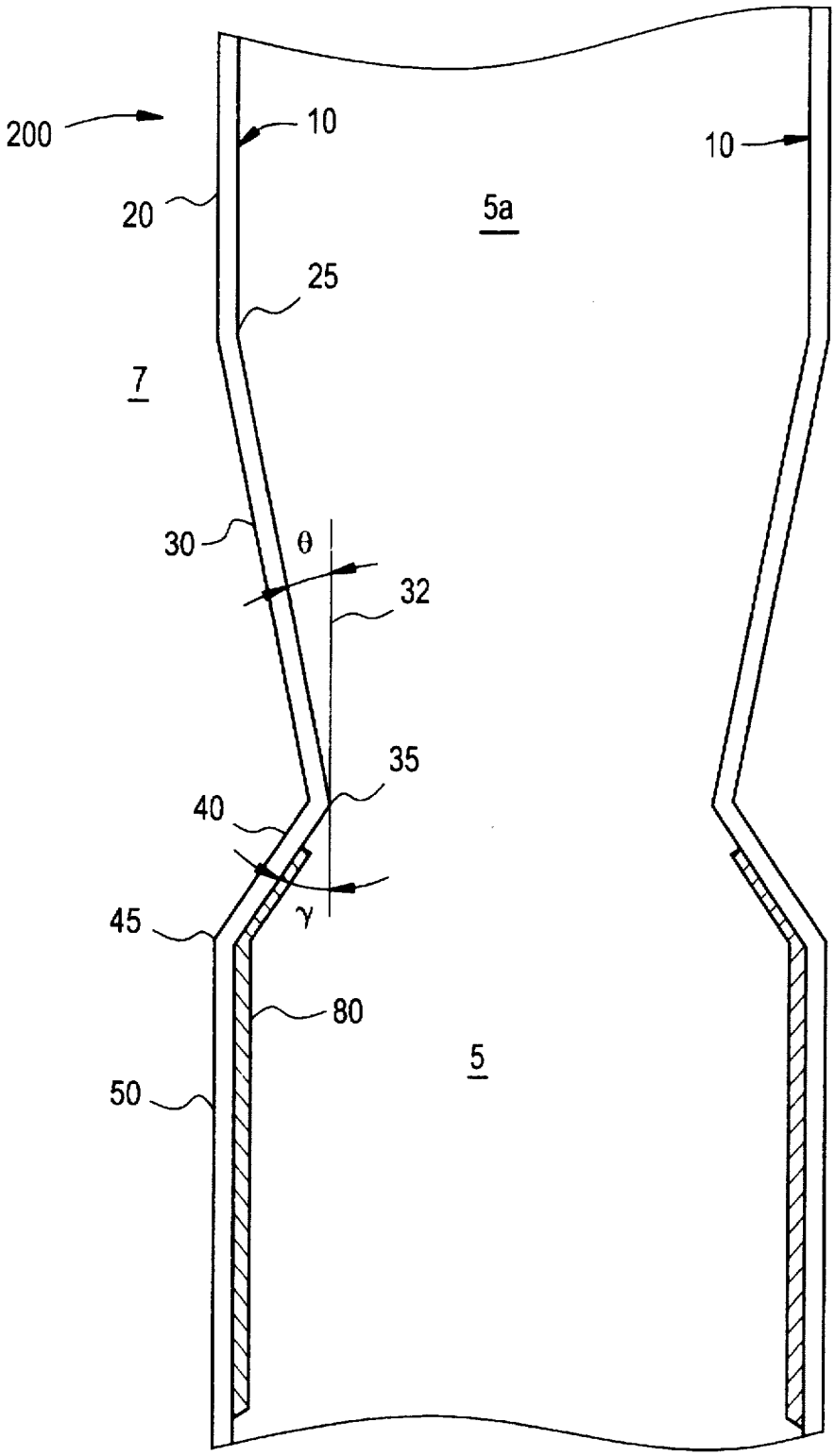
FIG. 1 is a sectional side elevational view of a fluidized bed having enclosure tube walls according to the invention.

Referring now to the drawings, in which the same or similar elements are identified with the same reference numerals, FIG. 1 shows a fluidized bed 200 having at least a pair of enclosure tube walls, generally designated 10, separating a circulating fluidized bed region 5, 5*a* from an outside region 7. Upper circulating fluidized bed region 5*a* contains many falling particles which have been fluidized below in fluidized bed refractory region 5.

Each enclosure tube wall 10 has several sections 20, 30, 40, 50 which connect at bends 25, 35, 45 to form the tube wall 10. Adjacent the upper circulating fluidized bed region 5*a*, upper wall section 20 is oriented substantially vertical, and may be supported by outside means or a circulating fluidized bed roof (not shown). The lower end of upper wall section 20 is connected to a gradual displacement wall section 30 at first bend 25.

The gradual displacement wall section 30 is oriented obliquely to a vertical axis 32 and inclines toward the circulating fluidized bed region 5*a*, 5. The angle θ formed between normal axis 32 and the gradual displacement wall section 30 is preferably less than or equal to 10°. The gradual displacement wall section 30 should be at least 30 inches in length. A reverse bend section 40 is connected to the end of gradual displacement wall section 30 at second bend 35.

Reverse bend section 40 is oriented obliquely to normal axis 32 away from the fluidized bed refractory region 5. The angle γ formed between reverse bend section 40 and the vertical axis may be greater than the angle θ. Bottom wall section 50 connects to the reverse bend section 40 at final bend 45. Bottom wall section 50 may be oriented vertically, or at an oblique angle, either into or away from fluidized bed refractory region 5.

Protective refractory coating 80 continuously lines the interior sides of bottom wall section 50 and reverse bend section 40 which face into the fluidized bed refractory region 5. The refractory coating 80 does not extend along the entire length of reverse bend section 40, and may terminate at a point along the length of reverse bend section 40. Substantially all of the interior side of bottom wall section 50 is lined with refractory coating 80.

The enclosure wall 10 has reduced erosion of the refractory coating 80 and the wall sections 40, 50 adjacent the coating 80. The protrusion of gradual displacement wall section 30 and reverse bend section 40 into the circulating fluidized bed region 5, 5*a* forces particles to fall away from the lower refractory-lined wall sections 40, 50 below the second bend 35, by either deflecting the particles inward, or simply by the narrowing of the circulating fluidized bed throat at second bend 35.

Figure 2:
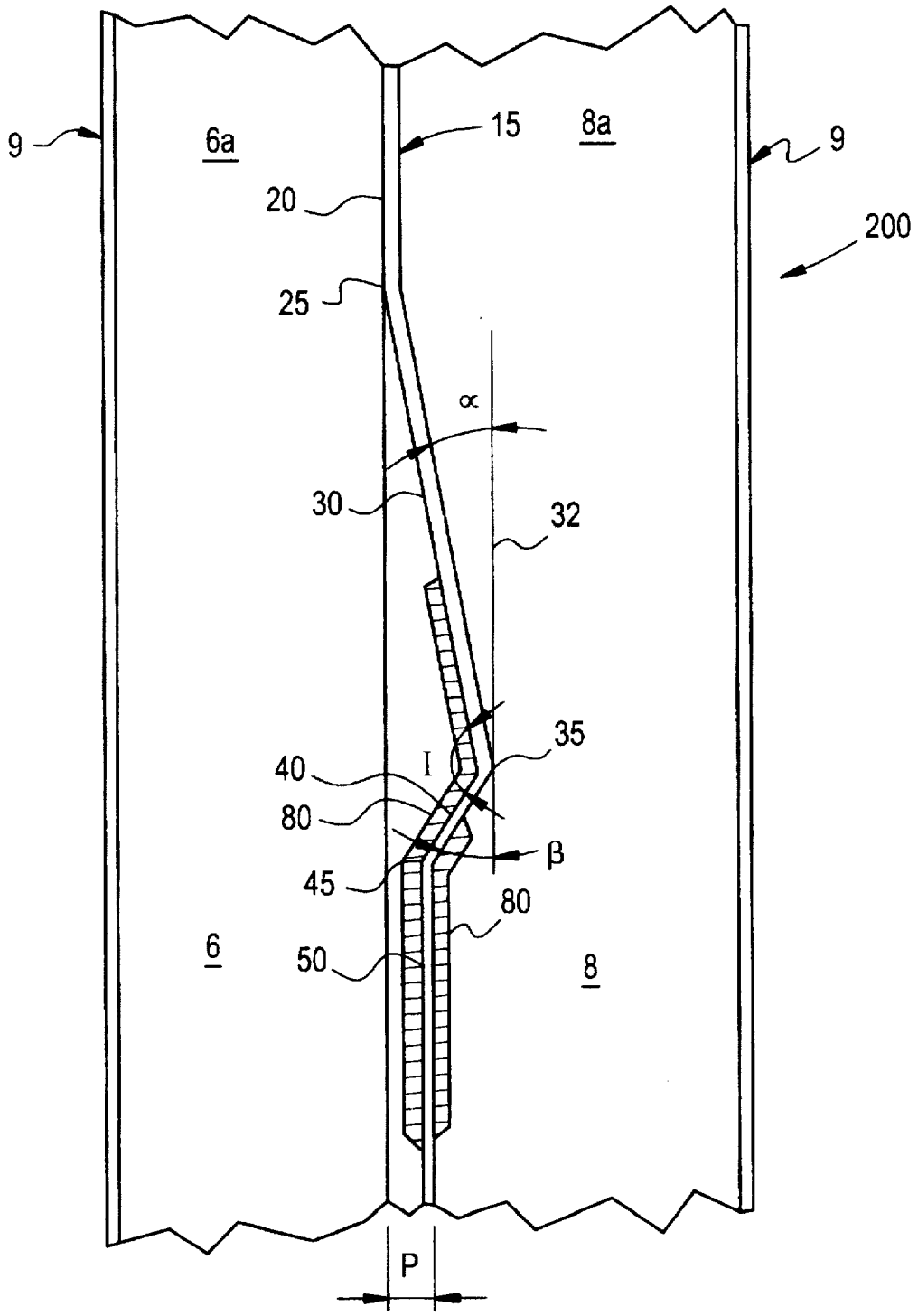
FIG. 2 is a sectional side elevational view of a fluidized bed having an interior tube wall according to another embodiment of the invention.

In the second embodiment of the water tube wall, shown in FIG. 2 and generally designated 15, the tube wall 15 is an interior wall of the circulating fluidized bed 200. The tube wall 15 may or may not extend to the roof of the circulating fluidized bed 200 enclosure defined by enclosure walls 9. The tube wall 15 divides the circulating fluidized bed 200 into two regions. A first fluidized bed region 6, 6*a* is one side of tube wall 15 and a second fluidized bed region 8, 8*a* is on the other side.

Each of the first and second fluidized bed regions, 6, 6*a*, 8, 8*a* has an upper circulating fluidized bed region 6*a*, 8*a* from which particles are continuously falling downward and being carried up from refractory regions 6, 8. Particles tend to fall adjacent to the enclosure walls 9 and the tube wall 15, while rising on gas flows in the center of the regions 6, 6*a*, 8, 8*a*.

The tube wall 15 is similar in construction to the enclosure tube wall 10 of FIG. 1. Upper wall section 20 connects at first bend 25 to gradual displacement wall section 30, which is inclined toward second fluidized bed region 8, 8*a*. Reverse bend section 40 is connected at second bend 35 at the lower end of gradual displacement wall section 30, and is oriented inclined toward first fluidized bed region 6, 6*a*. Bottom wall section 50 extends vertically downward from third bend 45 at the other end of reverse bend section 40.

Gradual displacement wall section 30 is preferably at least 60 inches long. Angle α, formed between normal 32 and gradual displacement wall section 30, is less than or equal to 10°. Angle β, formed between normal 32 and reverse bend section 40, may be the same or different from angle α. Depending on the angle β, the length of reverse bend 40 is selected such that bottom wall section 50 lies in a vertical plane which is between the vertical plane of the upper wall section 20 and the plane of normal 32, tangent to second bend 35 at the junction of gradual displacement wall section 30 and reverse bend section 40. A typical value for the horizontal displacement P between bottom wall section 50 and the plane of upper wall section 20 is four inches. The values for the angle β and the length of reverse bend section 40 are adjusted accordingly.

Protective refractory coating 80 lines both sides of bottom wall section 80 since tube wall 15 is an interior wall. The refractory coating 80 lines at least a part of the side of reverse bend section 40 opposite the included angle I formed between reverse bend section 40 and gradual displacement wall section 30, but it should terminate before second bend 35. The refractory coating 80 completely lines the side of reverse bend section 40 facing the included angle I, and coating 80 lines at least a part of the side of gradual displacement wall section 30 facing the included angle I.

Thus, the reverse bend section 40 and bottom wall section 50 are protected on both sides; the side facing second circulating fluidized bed region 8, 8*a* of each wall section 40, 50 is protected by the protrusion of the second bend 35, which forces particles away from the tube wall 15, while the other side of each is protected by being offset back from the plane of the upper wall section 20 by displacement P.

While a specific embodiment of the invention has been shown and described in detail to illustrate the application of the principles of the invention, it will be understood that the invention may be embodied otherwise without departing from such principles.

What is claimed is:

1. A water tube wall with enhanced erosion protection for forming at least a part of an enclosure for a circulating fluidized bed combustor or reactor, the combustor or reactor having a bed region inside the enclosure, the wall comprising:

a substantially vertical upper wall section;

a gradual displacement wall section connected at a first bend end to a lower end of the upper wall section, the gradual displacement wall section oriented obliquely to a vertical axis such that the other end of the gradual displacement wall section extends into the bed region;

a reverse displacement wall section connected at a second bend end to the other end of the gradual displacement wall section, the reverse displacement wall section oriented obliquely to the normal axis such that a bottom end of the reverse displacement wall section extends away from the bed region;

a bottom wall section connected at a final bend end to the bottom end of the reverse displacement wall section; and a protective refractory material continuously covering at least a portion of a side facing the bed region of each of the reverse displacement wall section and the bottom wall section.

2. A water tube wall according to claim 1, wherein a first bend angle formed between the gradual displacement wall section and the normal axis is no more than 10°.

3. A water tube wall according to claim 2, wherein a length of the gradual displacement wall section is at least 30 inches.

4. A water tube wall according to claim 3, wherein a second bend angle formed between the reverse displacement wall section and the normal axis is greater than the first bend angle.

5. A water tube wall according to claim 2, wherein a second bend angle formed between the reverse displacement wall section and the normal axis is greater than the first bend angle.

6. A water tube wall according to claim 1, wherein the bottom wall section is oriented obliquely to the vertical axis.

7. A water tube wall according to claim 6, wherein the second end of the bottom wall section is oriented into the bed region.

8. A water tube wall according to claim 6, wherein the second end of the bottom wall section is oriented away from the bed region.

9. A water tube wall or heat transfer surface having erosion resistant properties for use as an interior wall inside an enclosure of a circulating fluidized bed combustor or reactor, the combustor or reactor having a bed region inside the enclosure, the wall dividing the bed region into first and second bed regions, the wall comprising:

a substantially vertical upper wall section, defining an upper wall plane;

a gradual displacement wall section connected at a first bend end to a lower end of the upper wall section, the gradual displacement wall section oriented obliquely to a normal axis such that the other end of the gradual displacement wall section extends into the first bed region;

a reverse displacement wall section connected at a second bend end to the other end of the gradual displacement wall section, the reverse displacement wall section oriented obliquely to the normal axis such that a bottom end of the reverse displacement wall section extends away from the first bed region;

a bottom wall section connected at a final bend end to the bottom end of the reverse displacement wall section, the bottom wall section oriented substantially vertically and in a bottom section plane located between the upper wall plane and a vertical plane tangential to the second bend end of the gradual displacement wall section; and a protective refractory material continuously covering at least a portion of both sides of each of the reverse displacement wall section and the bottom wall section and at least a portion of a gradual displacement wall side forming an inside angle with the reverse displacement wall.

10. A water tube wall or heat transfer surface according to claim 9, wherein a first bend angle formed between the gradual displacement wall section and the normal axis is no more than 10°.

11. A water tube wall or heat transfer surface according to claim 10, wherein a length of the gradual displacement wall section is at least 60 inches.

12. A water tube wall or heat transfer surface according to claim 11, wherein a second bend angle formed between the reverse displacement wall section and the normal axis is greater than the first bend angle.

13. A water tube wall or heat transfer surface according to claim 10, wherein a second bend angle formed between the reverse displacement wall section and the normal axis is greater than the first bend angle.

14. A water tube wall or heat transfer surface according to claim 10, wherein a horizontal distance between the upper wall plane and the bottom wall section is about 4 inches.

* * * * *